United States Patent [19]

Scheiderer

[11] 4,291,745

[45] Sep. 29, 1981

[54] FOUNDRY MOLD JACKET

[75] Inventor: Willard R. Scheiderer, Wausaukee, Wis.

[73] Assignee: Grede Foundries, Inc., Milwaukee, Wis.

[21] Appl. No.: 103,453

[22] Filed: Dec. 14, 1979

[51] Int. Cl.[3] ..... B22C 21/00

[52] U.S. Cl. ..... 164/394; 164/412

[58] Field of Search ..... 164/394, 395, 396, 374, 164/385, 137

[56] References Cited

U.S. PATENT DOCUMENTS

| | | | |
|---|---|---|---|
| 1,002,522 | 9/1911 | Kimball | 164/396 |
| 1,588,269 | 6/1926 | Rourke | 164/396 |
| 2,473,160 | 6/1949 | Madrigal | 164/394 |
| 2,575,103 | 11/1951 | Gavin, Sr. | 164/394 X |
| 3,060,532 | 10/1962 | Jones et al. | 164/394 |

*Primary Examiner*—Robert D. Baldwin
*Assistant Examiner*—J. Reed Batten, Jr.
*Attorney, Agent, or Firm*—Andrus, Sceales, Starke & Sawall

[57] ABSTRACT

A foundry mold jacket to be positioned around a sand mold during pouring of the molten metal. The jacket has a generally rectangular body portion having a central opening to receive the sand mold. The jacket has a depth of approximately six inches and straddles the parting line of the mold. Extensions or lugs extend outwardly from opposite sides of the body portion and locating members are disposed on the upper surfaces of the extensions for positioning a weight on the upper surface of the jacket body. In addition, the extensions are provided with locating holes which receive locating pins on lifting arms that raise and lower the mold jacket relative to the sand mold.

7 Claims, 3 Drawing Figures

FOUNDRY MOLD JACKET

BACKGROUND OF THE INVENTION

In foundry practice, mole jackets are utilized in conjunction with sand molds during the pouring of molten metal. The sand mold is conventionally formed in mating upper and lower halves, which, in combination, define one or more cavities adapted to receive the molten metal. The outer surface of the sand mold is provided with slope or draft, and prior to pouring, a mold jacket is placed around the mold and straddles the parting line between the mold halves. In addition, a weight, in the form of a metal plate, is placed on the upper surface of the upper mold half.

The mold jacket in combination with the weight serves to prevent the upper mold half from rising relative to the lower half due to the pressure of the molten metal and thus serves to minimize run-out of the molten metal along the parting line. Nevertheless, with the use of conventional mold jackets there are instances of run-out of the molten metal, and the run-out can be a potential hazard to the operator.

SUMMARY OF THE INVENTION

The invention is directed to an improved mold jacket which will eliminate run-out of the molten metal along the parting line of the sand mold. The mold jacket of the invention comprises a generally rectangular body portion having a central opening to receive the sand mold. The body portion of the jacket has a depth of about 6 inches and is adapted to straddle the parting line on the mold.

Extending outwardly from opposite sides of the body portion are lugs or extensions, and locating members extend upwardly from each extension and are adapted to be received within recesses formed in the lower surface of a weight. The locating members serve to properly position the weight with respect to the jacket during periods when the weight is supported on the jacket.

In addition, each extension or lug is provided with a hole which receives a locating pin on a lifting arm. The lifting arms are adapted to engage the lower surfaces of the extensions and lift the mold jacket and weight to an elevated position and then to lower the jacket and weight onto the sand mold.

The lower surfaces of the extension can be formed with recesses or grooves, which under certain conditions, can engage a fixed supporting arm to limit the downward movement of the mold jacket when the mold jacket is not being carried by the lifting arms.

As the jacket extends a substantial distance on either side of the parting line, generally about three inches, the run-out of molten metal along the parting line is minimized. By eliminating run-outs, the potential safety hazard to the operator is substantially reduced.

The walls of the body portion of the jacket are tapered to accommodate the sloping outer surface of the sand mold, and due to the taper, the lower edge of the jacket wall is relatively thin. With the use of conventional jackets, the lower thin edge of the jacket is relatively close to the parting line of the mold, which is the region of highest temperature. Because of the intense heat, there has been a tendency, in the past, for the lower edge of the wall to crack requiring replacement of the jacket. Due to the additional depth of the jacket of the invention, the lower thin edge of the wall is located a substantial distance beneath the parting line where it is not subjected to the intense heat, thereby reducing the tendency for the lower edge of the jacket to crack.

With the use of the mold jacket of the invention, the wall thickness of the sand mold can be reduced, which results in a greater yield of cast parts for a mold of given dimensions.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
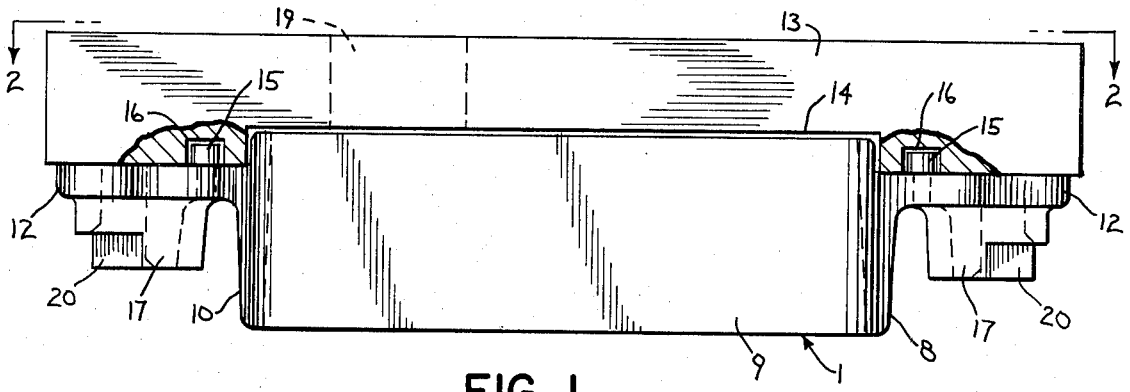
FIG. 1 is a side elevation of the mold jacket of the invention supporting a weighted plate.
Figure 2:
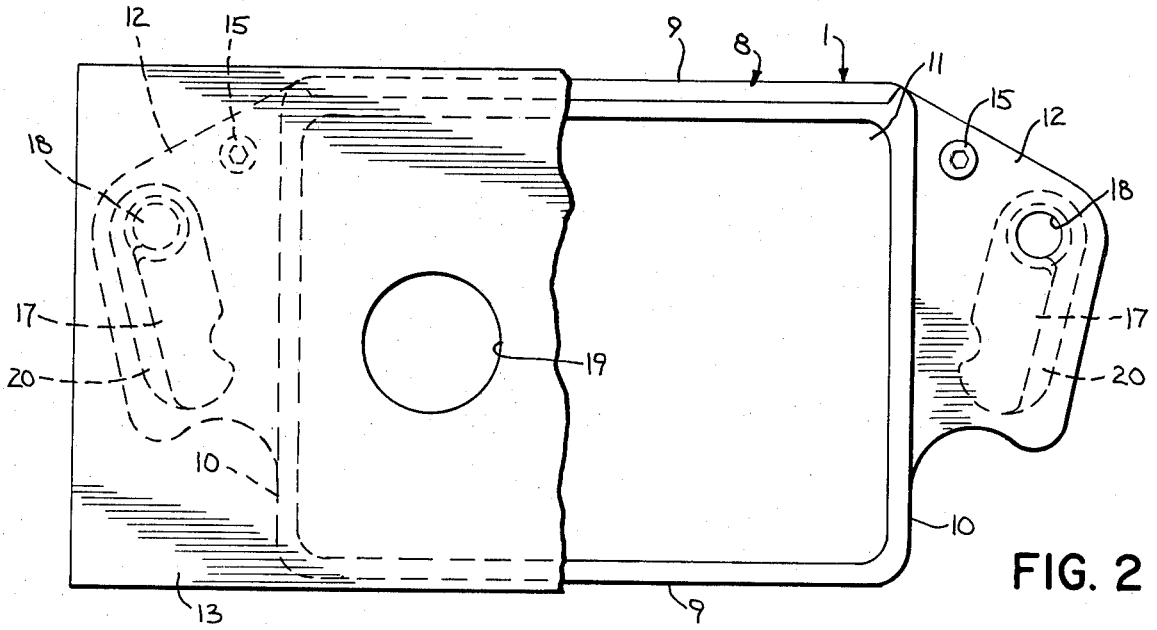
FIG. 2 is a horizontal section taken along line 2—2 of FIG. 1.
Figure 3:
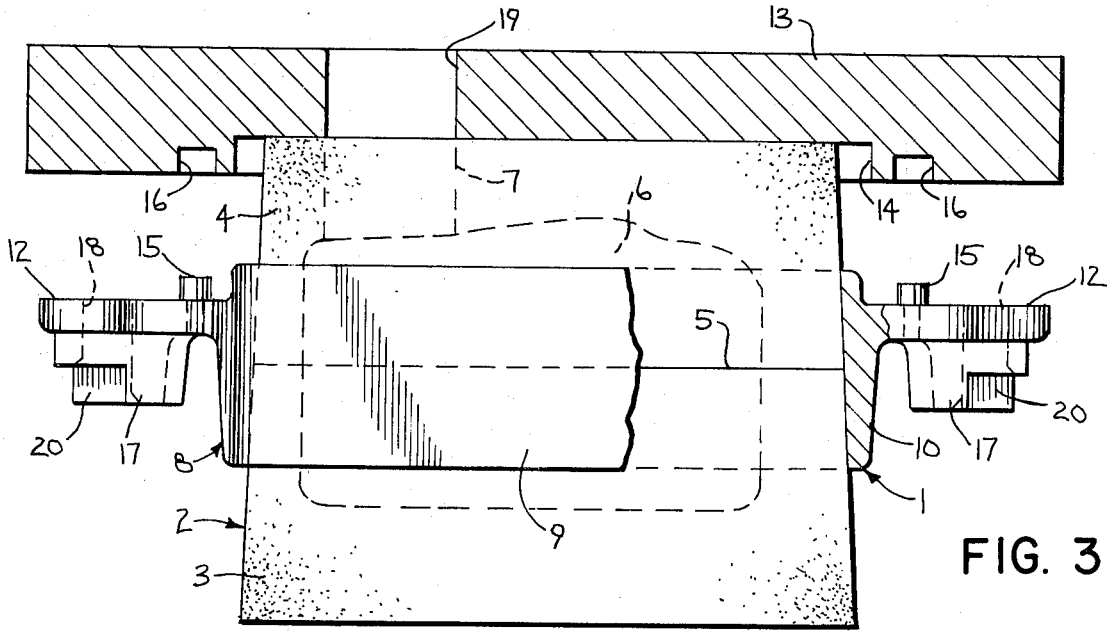
FIG. 3 is a vertical section showing the mold jacket in position around the sand mold with the weighted plate being supported on the upper surface of the mold.

The drawings illustrate a mold jacket 1 which is adapted to be positioned around a sand mold 2 during pouring of the molten metal. As illustrated in FIG. 3, the sand mold 2 is a conventional type and has a generally rectangular configuration, composed of a lower half 3 and a mating upper half 4, which are joined at a parting line 5. The mold halves 3 and 4 define one or a plurality of cavities 6 and molten metal is adapted to be poured into the cavities 6 through a sprue 7 in the upper mold half 4.

The mold jacket 1 has a generally rectangular configuration and includes a body portion 8 composed of a pair of side walls 9 and a pair of end walls 10 which define a central opening 11 that receives the sand mold 2. As best illustrated in FIG. 3, the inner surfaces of walls 9 and 10 diverge downwardly and outwardly, being provided with a slope or draft of approximately 4°, which corresponds to the slope or draft of the outer surface of the mold 2. Lugs or extensions 12 extend outwardly from the end walls 10.

The walls 9 and 10 have a height or depth of approximately six inches and extend approximately three inches on either side of the parting line 5.

During pouring, a weight 13 in the form of a metal plate is supported on upper mold half 4 and functions in combination with the mold jacket to prevent the upper mold half from rising due to the pressure of the molten metal. During certain nonpouring phases of the operation the weight 13 is supported on the jacket. The weight 13 is provided with a central recess 14 which receives the upper edges of walls 9 and 10, do that the weight can rest flatwise on the upper surfaces of the extensions 12. In this supporting position, locating bolts 15 on extensions 12 are received within the recesses 16 formed in the lower surface of the weight.

Each extension 12 includes a downwardly extending projection 17, and each projection is formed with a hole 18 that is adapted to receive an upstanding location pin on a lifting arm that is utilized to raise and lower the mold jacket. As shown in FIG. 3, the extensions 12, which include the projections 17, extend vertically on either side of a horizontal plane passing through the vertical midpoint of the body portion 8. In an automatic mold handling and pouring machine, the lifting arms, not shown, are adapted to engage the lower surfaces of the projections 17 and serve to elevate the mold jacket and the weight 13 to an elevated position to enable the sand mold to be positioned beneath the jacket. After the mold is positioned beneath the elevated jacket, the arms are lowered to thereby lower the jacket and weight downwardly onto the sand mold, as shown in FIG. 3. In this pouring position, the walls 9 and 10 of the body of the jacket will straddle the parting line 5 of the mold, while the weight 13 rests on the upper surface of the mold half 4. The weight is not fixed to the jacket, so that when the weight engages the upper mold half 4, further downward movement of the weight is halted while the jacket will continue to move downwardly to the position shown in FIG. 3.

In certain phases of the operation of the automatic mold handling and pouring machine, the downward movement of the mold jacket, when not carried by the lifting arms, is limited by engagement of the extensions 12 with fixed arms or stops on the machine. As illustrated in FIG. 3, each projection 17 is formed with a recess or step 20 along its lower edge and the step is adapted to engage the stop to limit the downward movement of the mold jacket.

As previously related, the mold jacket of the invention has particular use in automatic mold handling and pouring machines. In machines of this type, the sand molds are conveyed to a turntable and each mold is positioned at an entry station. Indexing of the turntable moves each mold through a series of stations, one of which is a metal pouring station. After pouring, the mold is returned to the entry station and discharged from the turntable. At the entry station, the mold jacket 1 is supported in an elevated position by the lifting arms and the weight 13 is supported by the mold jacket. After the sand mold 2 is positioned under the jacket, at the entry station, the jacket is lowered through operation of the lifting arms to position the mold jacket around the mold as shown in FIG. 3. As the weight is not fixed to the mold jacket, the weight on lowering of the jacket, will engage the upper surface of the mold and will rest on the upper surface of the mold out of contact with the jacket. The weight 13 is provided with a suitable hole or opening 19 through which the molten metal is poured into sprue 7.

After pouring and solidification of the molten metal, the mold is returned to the entry station where the lifting arms operate to elevate the mold jacket 1, and elevation of the jacket carries the weight 13 upwardly with the jacket. The mold can then be removed from the turntable of the machine.

Due to the substantial depth of the walls 9 and 10, the mold jacket 1 prevents run-out of molten metal along the parting line 5 of the mold and thus prevents the molten metal from contacting the operator.

As the lower edges of walls 9 and 10 are located a substantial distance beneath the parting line, which is the area of highest temperature, the possibility of cracking of the lower edge of the wall is minimized. This results in the mold jacket having a considerably longer service life than mold jackets as used in the past.

As a further advantage, the substantial depth of the mold jacket reduces crumbling of the mold along the parting line and thereby enables the walls of the sand mold to be reduced in thickness. Reducing the thickness of the walls provides a substantial improvement in the yield of the cast products for a given size mold. For example, with the use of conventional mold jackets, the walls of the sand mold had a thickness of at least 2 inches. With the use of the mold jacket of the invention, the wall thickness of the mold can be reduced to approximately one inch. Reduction in the wall thickness produces a corresponding increase in yield for a mold of given dimensions.

Various modes of carrying out the invention are contemplated as being within the scope of the following claims particularly pointing out and distinctly claiming the subject matter which is regarded as the invention.

I claim:

1. A foundry mold jacket, comprising a body portion having a central opening adapted to receive a sand mold having mating upper and lower halves joined along a horizontal parting line, said body portion having a substantial depth and adapted to straddle the parting line of the mold, a pair of extensions extending laterally from opposite sides of the body portion, said extensions extending vertically on either side of a horizontal plane passing through the vertical mid-point of said body portion, first locating means on the upper surface of each extension and adapted to position a separate weight on the upper surface of the body portion, and second means on each extension aligning a lifting means with said extension and adapted to receive a lifting member capable of lifting said jacket.

2. The jacket of claim 1, wherein the body portion has a vertical depth in the order of 6 inches.

3. The jacket of claim 1, wherein said first locating means comprises an upstanding member on each extension.

4. The jacket of claim 1, wherein said second means comprises a hole in each extension.

5. The jacket of claim 1, wherein said body portion is generally rectangular in shape and includes a pair of first walls and a pair of opposed second walls.

6. The jacket of claim 5, and including a recess formed in the lower edge of each extension, each recess extending at an acute angle to the respective second wall and adapted to receive a fixed support to limit the lower position of said jacket.

7. A foundry mold jacket, comprising a body portion having a central opening and adapted to receive a sand mold having mating upper and lower halves joined along a horizontal parting line, said body portion being generally rectangular in shape and including a pair of first walls and a pair of opposed second walls, said body portion having a substantial depth and adapted to extend a substantial distance on either side of the parting line of the mold, a pair of extensions extending laterally from second walls of the body portion, first locating means disposed on the upper surface of each extension and adapted to engage and position a weight on the upper surface of the body portion, means on each extension and adapted to receive a lifting member capable of lifting said jacket, the outer lower edge of each extension having a recess extending at an acute angle to the respective second wall and adapted to receive a fixed support to limit the lower position of said jacket.

* * * * *

UNITED STATES PATENT AND TRADEMARK OFFICE

CERTIFICATE OF CORRECTION

PATENT NO. : 4,291,745

DATED : September 29, 1981

INVENTOR(S) : WILLARD R. SCHEIDERER

It is certified that error appears in the above-identified patent and that said Letters Patent are hereby corrected as shown below:

Col. 2, Line 57, Cancel "do" and substitute therefor ---so---,
Col. 4, Line 56, CLAIM 7, After "from" and before "second" insert ---said---.

Signed and Sealed this

*Thirtieth* Day of *March 1982*

[SEAL]

*Attest:*

GERALD J. MOSSINGHOFF

*Attesting Officer*

*Commissioner of Patents and Trademarks*